United States Patent [19]

Faasse et al.

[11] Patent Number: 4,924,916

[45] Date of Patent: May 15, 1990

[54] HARNESS FRAME WITH DROP-THROUGH BOLTED CENTERBRACE

[75] Inventors: Gene E. Faasse, Greer; James E. Howard, Travelers Rest, both of S.C.

[73] Assignee: Steel Heddle Mfg. Co., Greenville, S.C.

[21] Appl. No.: 353,968

[22] Filed: May 19, 1989

[51] Int. Cl.[5] ..... D03C 9/06
[52] U.S. Cl. ..... 139/91
[58] Field of Search ..... 139/91, 92

[56] References Cited

U.S. PATENT DOCUMENTS

| | | | |
|---|---|---|---|
| 2,905,204 | 9/1959 | Kaufmann | 139/92 |
| 2,909,199 | 10/1959 | Kaufmann | 139/91 |
| 2,944,571 | 7/1960 | Pfarrwaller | 139/91 |
| 3,889,721 | 6/1975 | Wagner | 139/91 |

FOREIGN PATENT DOCUMENTS

| | | | |
|---|---|---|---|
| 1375880 | 9/1964 | France | 139/92 |
| 371413 | 9/1963 | Switzerland | 139/92 |

*Primary Examiner*—Henry S. Jaudon
*Attorney, Agent, or Firm*—Dority & Manning

[57] ABSTRACT

A heddle frame for holding a plurality of heddles comprising a top rail and a bottom rail. Each of the rails has heddle supporting bars attached to them for supporting the heddles within the frame, and the top and bottom rails are held in parallel relationship to each other by end members attached to their adjacent ends. Intermediate the end members is a center brace which may be located in alternative positions within the heddle frame. Each of the rails has an opening to receive the centerbrace and to support it so as to maintain the parallel positions of the top and bottom rails. The holes within the rails are reinforced with steel reinforcing guide tubes which resist the wear of the centerbrace during the use of the heddle frame and protects the rails.

7 Claims, 3 Drawing Sheets

HARNESS FRAME WITH DROP-THROUGH BOLTED CENTERBRACE

BACKGROUND OF THE INVENTION

This invention relates to a heddle frame for a loom, and in particular to improved means in such heddle frames for preventing distortion with respect to the top and bottom rails of the frame and for simplifying the adjustment of the frame.

A known harness frame with a centerbrace is disclosed in U.S. Pat. No. 2,909,199. In this patent, the heddle frame comprises top and bottom rails which may be made of wood or extruded aluminum. The top and bottom rails are connected at each end by end struts to provide a rigid connection between the ends of the top and bottom rails to maintain the top and bottom rails at fixed distances apart.

The known heddle frame also includes top and bottom heddle supporting rods upon which the heddles are slidably mounted. The heddle rods are supported from the top and bottom rails by brackets or hooks. A stay or brace is mounted midway the ends of the frame and in some instances a plurality of braces may be employed where the width of the frame makes this desirable. The lower end of the brace is threaded in a member which is secured to the inner edge of the lower rail by wood screws. The upper end of the brace is also threaded into a headpiece which may be rectangular or other noncircular configuration. The headpiece is secured to the threaded upper end of the brace by means of a pin. The headpiece is seated into a recess of an upper locking member which is fastened by means of wood screws to the outer edge of the top rail of the frame. The upper end of the centerbrace is secured by a locking member which has a recess for the headpiece and which prevents rotation of the centerbrace when the locking member is in its operative position. The locking member is secured in the locking position by wood screws which pass into the top rail.

The harness frame of this patent offers support to the centerbrace but only in one predetermined location at or near the center of the frame. Furthermore, the use of the frame causes the centerbrace to move relative to the top and bottom rails resulting in undue wear.

Another well-known harness frame is an adjustable centerbrace as disclosed in U.S. Pat. No. 3,417,790. In this device, the adjustable centerbrace is extremely difficult to align in the harness frame and to correctly torque the holding screws which hold the centerbrace in place in the top and bottom rails. In this device, the final positioning of the centerbrace must be completed in the weaving machine after the warp has been drawn into the heddles with the warp and the top rails obstructing the view of the operator making the adjustment. This makes it very difficult to engage and to use the tools necessary to tighten the supports for the centerbrace. Furthermore, use of the tools within the presence of the warp threads results in damage to the warp threads during the installation of the center stays. This is a significant disadvantage.

SUMMARY OF THE INVENTION

The present invention comprises a heddle frame with a centerbrace which may be dropped into place in the top and bottom rails without the use of tools in the space between the top and bottom rails.

Accordingly, it is the object of the present invention to provide a heddle frame with an adjustable centerbrace which can be assembled in two or more positions without the need to insert tools within the space between the top and the bottom rails of the frame.

It is another object of the invention to provide a heddle frame wherein the time for installing and removing the centerstays or braces is considerably less, and simplified.

BRIEF DESCRIPTION OF THE INVENTION

DETAILED DESCRIPTION OF THE DRAWINGS

Figure 1:
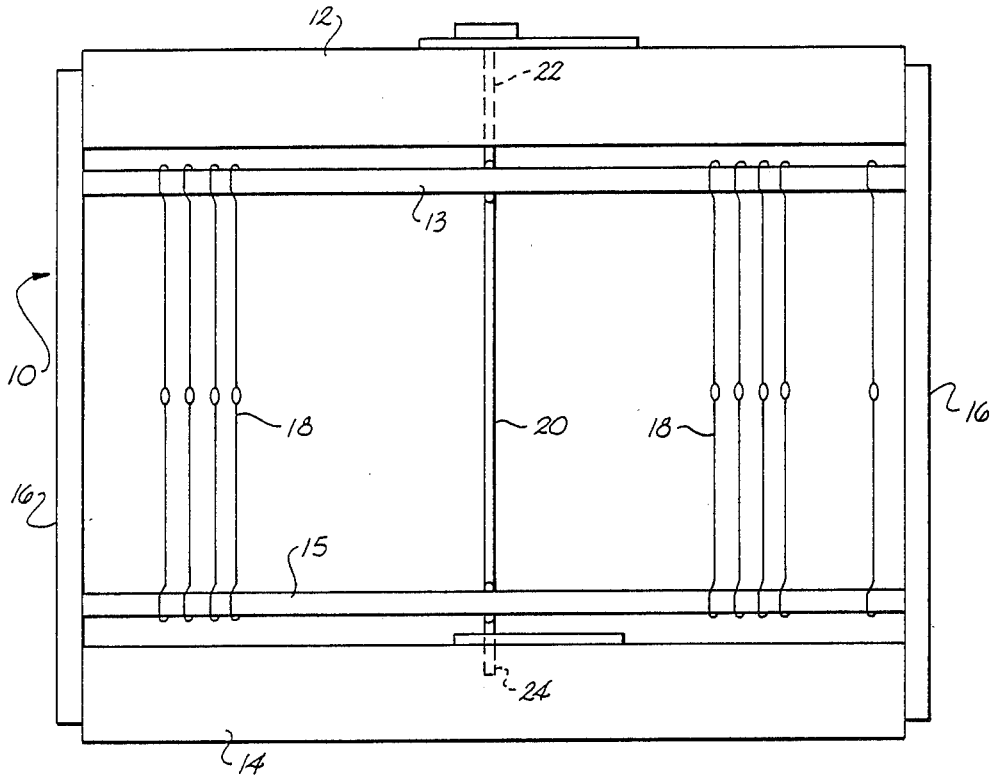
FIG. 1 is a front elevation of the heddle frame of the invention.
Figure 6:
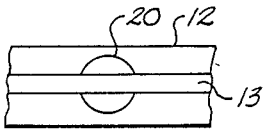
FIG. 6 is a cross-sectional view of the centerbrace taken along line 6—6 of FIG. 2.

Referring now to FIG. 1 of the drawings wherein is illustrated the heddle frame of the invention. Heddle frame 10 comprises a top rail 12 and a bottom rail 14 which extend generally horizontally at a spaced distance from each other. The frame is completed by end members 16 joining top and bottom rails 12 and 14 at each of their ends to form a rectangular frame. The frame also comprises a top heddle bar 13 and a bottom heddle bar 15 on which are suspended a plurality of warp heddles 18.

Between end members 16 is a centerbrace 20. Centerbrace 20 connects the top rail 12 with bottom rail 14 to provide additional support for maintaining the top and bottom rails parallel to each other. Centerbrace 20 extends through a top opening 22 in top rail 12 and into a bottom opening 24 in bottom rail 14. The means for fastening centerbrace 20 in its position will be described in more detail hereinafter with regard to FIGS. 2 and 3 of the drawings. At this point it should be noted that centerbrace 20 may alternately extend through top opening 22' and into bottom opening 24' if desired, so the operator has an alternative position for the centerbrace.

Figure 2:
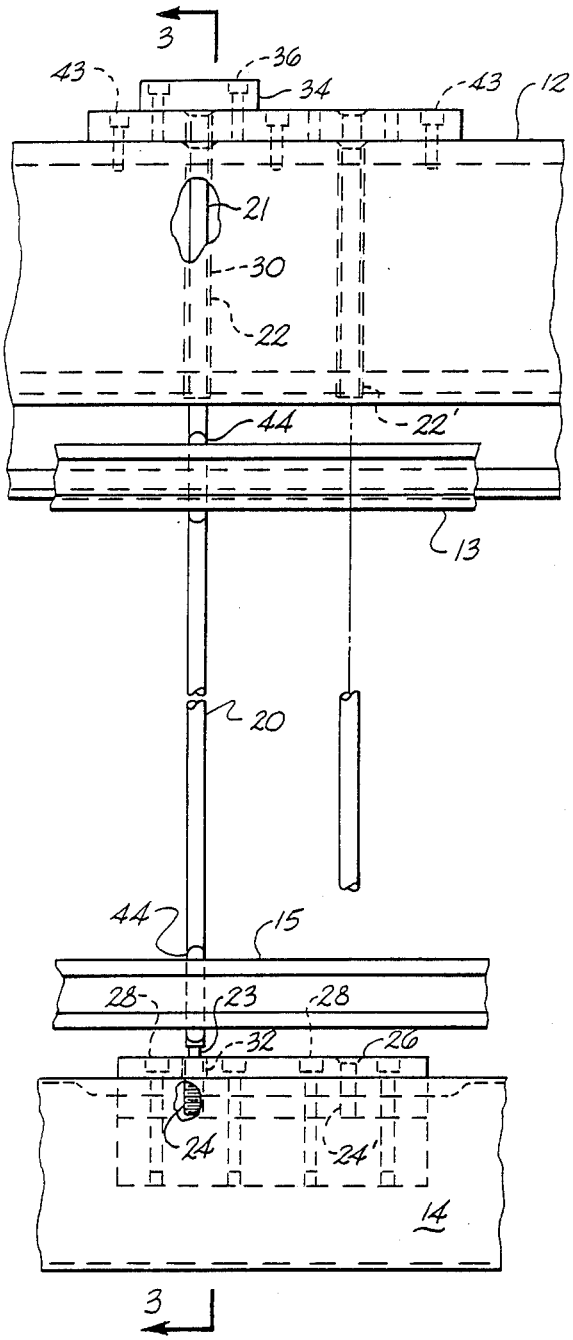
FIG. 2 is an enlarged front elevation of the centerbrace of the heddle frame illustrated in FIG. 1.
Figure 3:
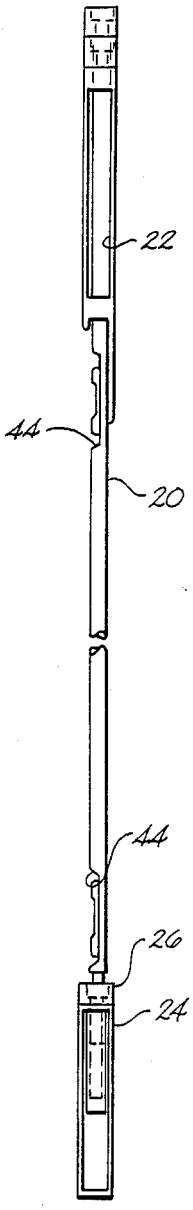
FIG. 3 is a side cross-sectional view of the heddle frame illustrated in FIGS. 1 and 2 taken along line 3—3 of FIG. 2.

Referring now to FIGS. 2 and 3 of the drawings wherein the centerbrace and its supporting structure is shown on a larger scale, in more detail. It will be noted that centerbrace 20 has a top end 21 which extends through opening 22 in the top rail 12 and a bottom end 23 which extends into opening 24 of the bottom rail. Top opening 22 is provided with a top sleeve 30 which may be a steel guide tube which is fixed within opening 22 and through which top end 21 of the centerbrace extends. At the same time, bottom opening 24 has a bottom sleeve 32, which extends through opening 24 in nut block 26, for receiving the bottom end 23 of centerbrace 20. Nut block 26 is fastened to the top of the bottom rail 14 by a plurality of machine bolts or screws 28. Bottom end 23 of the centerbrace 20 is threaded into bottom sleeve 32.

The top end 21 of brace 20 terminates in an integral cap 34 which is fastened to an upper nut block 42 by a plurality of machine screws or bolts 36. The upper nut block 42 is held in place on the top of the upper or top rail by a plurality of machine screws or bolts 43.

Figure 4:
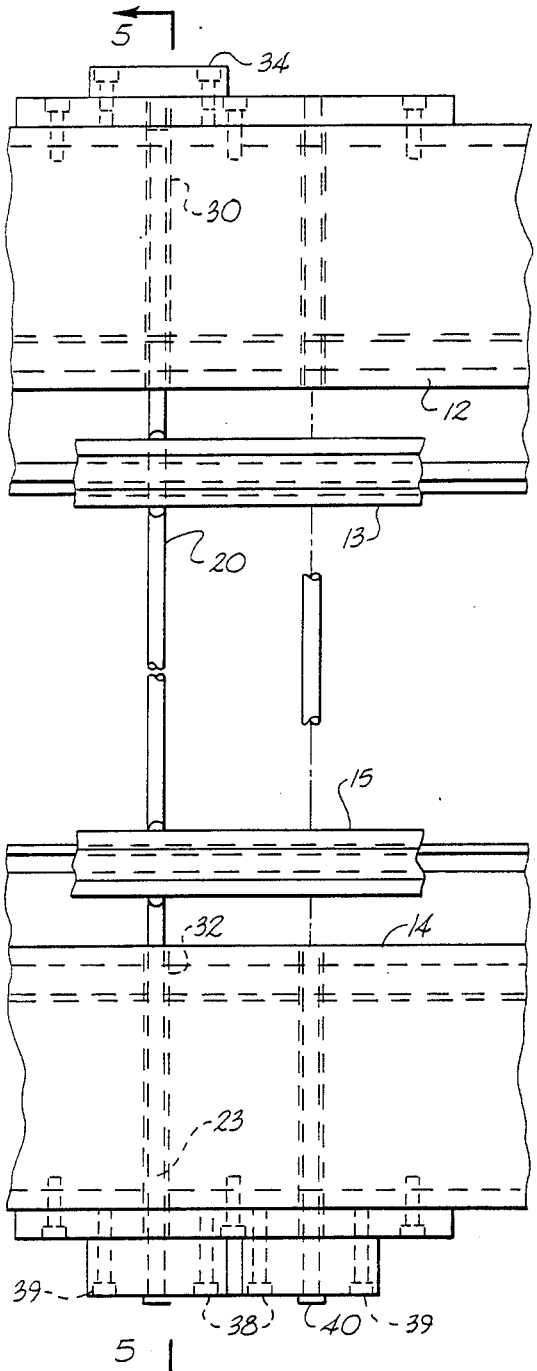
FIG. 4 is a view similar to that of FIG. 2 but showing an alternative embodiment of the centerbrace.
Figure 5:
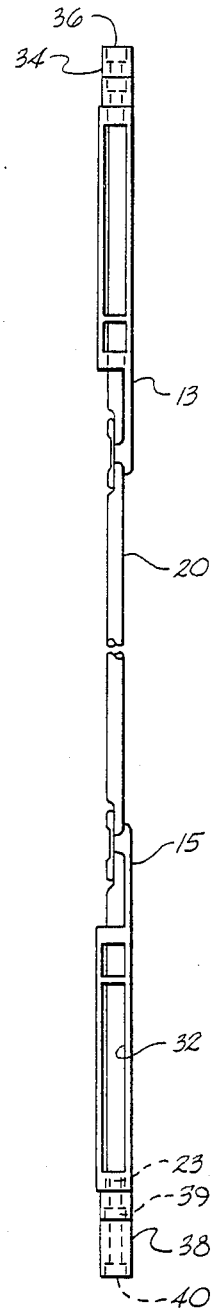
FIG. 5 is a view, similar to FIG. 3, of the alternative embodiment illustrated in FIG. 4 taken along line 5—5 of FIG. 4.

Referring now to FIGS. 4 and 5 wherein an alternative embodiment of the heddle frame illustrated in FIGS. 1 through 3 is illustrated. In this embodiment, the bottom end 23 of centerbrace 20 extends completely through bottom rail 14 and into a lower nut block 38 which is held on the lower surface of the bottom rail by means of a plurality of machine screws or bolts 39. In this embodiment, the centerbrace 20 is longer than that disclosed with regard to the first embodiment in that the bottom end 23 of brace 20 is threaded into the lower nut block 38 which is outside of the area or space between the top and the bottom rails. The lower end of the opening 24 in the nut block 38 is closed by a machine screw or bolt 40.

It should also be noted that in each of the embodiments illustrated, the centerbrace 20 is notched at 44 to permit clearance of the heddle bars 13 and 15 and to permit the alignment of the heddles at the vertical centerline of the heddle frame Though two embodiments of the heddle frame of the invention have been illustrated herein, it will be appreciated that various modifications may be made without departing from the scope of the claims appended hereto.

That which is claimed:

1. A heddle frame for holding a plurality of warp heddles, comprising:

(a) a top rail extending longitudinally of said frame, having a heddle bar for supporting the upper ends of said heddles;

(b) a bottom rail extending longitudinally of said frame and generally parallel to said top rail, having a heddle bar for supporting the lower ends of said heddles;

(c) end members connecting each end of said top rail to the adjacent end of said bottom rail to provide a frame which is generally rectangular for supporting said heddles;

(d) aligned openings extending transversely through said top and said bottom rails at at least one point intermediate the ends of said rails;

(e) a center brace extending through one of said openings in said top rail and into an opening in said bottom rail aligned therewith;

(f) a top sleeve disposed in at least one of said openings in said top rail for the length of said opening and extending about said center brace to separate it from said opening in said top rail;

(g) a bottom sleeve disposed in said bottom rail and threaded onto said center brace; and (h) means disposed on the upper surface of said top rail to secure and retain said center brace within said openings to support and maintain the parallelism of said top and bottom rails.

2. A heddle frame as set forth in claim 1, wherein the lower end of said center brace is supported by a nut block attached to the upper surface of said bottom rail.

3. A heddle frame as set forth in claim 1, wherein the lower end of said center brace is supported in a nut block attached to the lower surface of said bottom rail.

4. A heddle frame as set forth in claim 1, wherein said top and bottom rails are hollow.

5. A heddle frame as set forth in claim 1, wherein the upper end of said center brace is integral with a cap which is fastened to a nut block attached to the upper surface of said top rail.

6. A heddle frame as set forth in claim 1 wherein said sleeve means comprises steel tubes.

7. A heddle frame as set forth in claim 1 wherein said top and bottom rails have a plurality of openings for receiving the center brace alternately.

* * * * *